US007256360B1

(12) United States Patent
Chou

(10) Patent No.: US 7,256,360 B1
(45) Date of Patent: Aug. 14, 2007

(54) ROLLING-BALL SWITCH

(76) Inventor: Tien-Ming Chou, No. 41, San-Hsi 5th St., Taichung City (TW)

( * ) Notice: Subject to any disclaimer, the term of this patent is extended or adjusted under 35 U.S.C. 154(b) by 0 days.

(21) Appl. No.: 11/535,865

(22) Filed: Sep. 27, 2006

(51) Int. Cl.
*H01H 35/02* (2006.01)
*H01H 35/14* (2006.01)

(52) U.S. Cl. ..... 200/61.45 R; 200/61.52

(58) Field of Classification Search ..... 73/514.01, 73/514.16; 200/61.45 R–61.45 M, 284, 200/292

See application file for complete search history.

(56) References Cited

U.S. PATENT DOCUMENTS 4,778,964 A * 10/1988 Kamisada ..... 200/284
5,208,430 A * 5/1993 Ludzia ..... 200/61.52
5,213,314 A * 5/1993 Kano et al. ..... 267/163
5,920,045 A * 7/1999 Suzuki et al. ..... 200/61.45 R
5,977,497 A * 11/1999 Tsunematsu ..... 200/283
6,028,275 A * 2/2000 Jou ..... 200/61.52
6,096,990 A * 8/2000 Marin ..... 200/535
6,448,516 B1 * 9/2002 Chiang ..... 200/61.45 R
7,045,724 B1 * 5/2006 Chou ..... 200/61.45 R

* cited by examiner

*Primary Examiner*—Michael A Friedhofer
(74) *Attorney, Agent, or Firm*—Sheridan Ross P.C.

(57) ABSTRACT

A rolling-ball switch includes a housing, at least two terminal rods, and a conductive ball. The housing defines a chamber, and has a bottom wall provided with at least two through holes. Each through hole is defined by a multi-sided hole wall. Each terminal rod has an inner end extending into the chamber through the respective through hole, an outer end that extends outwardly of the bottom wall and that is adapted to be inserted into a circuit board, a multi-sided lateral surface extending between the inner and outer ends, and at least one engaging member provided on the multi-sided lateral surface and engaging the hole wall of the respective through hole. The conductive ball is disposed movably in the chamber to contact separably the inner ends of the terminal rods.

11 Claims, 10 Drawing Sheets

ROLLING-BALL SWITCH

BACKGROUND OF THE INVENTION

1. Field of the Invention

The invention relates to a switch, more particularly to a rolling-ball switch that may be suitably mounted on a circuit board for providing triggering signals.

2. Description of the Related Art

Referring to FIGS. 1 and 2, a conventional switch 10, as disclosed by the applicant in Taiwanese Patent No. 155965, includes a housing, a conductive ball 12, and four terminal rods 14.

The housing includes a bottom seat 13 and a top cover 11. The bottom seat 13 is made of plastic, and has top and bottom surfaces, and four spaced-apart through holes 131 extending through the top and bottom surfaces. Each through hole 131 is defined by four interconnected hole walls 132. The top cover 11 is made of plastic, and has a top wall 111, and four interconnected side walls 112 extending downwardly from a peripheral end of the top wall 111. The top wall 111 and the side walls 112 cooperatively define a chamber 113 having a bottom opening 114.

Each of the terminal rods 14 has an inner end 141 located within the chamber 113, an outer end 142 located outwardly of the bottom seat 13, and four interconnected lateral surfaces 143 extending between the inner and outer ends 141, 142.

The conductive ball 12 is disposed in the chamber 113, and is movable toward the inner ends 141 of the terminal rods 14 so as to place the switch 10 in an "ON" state, or away from the inner ends 141 of the terminal rods 14 so as to place the switch 10 in an "OFF" state.

During assembly, the bottom seat 13 is inserted into the chamber 113 so as to close the bottom opening 114 and thereby confine the conductive ball 12 within the chamber 113. The terminal rods 14 are then inserted respectively and interferentially into the through holes 131 by a jig (not shown) so as to position the terminal rods 14 in the respective through holes 131. The outer ends 142 of the terminal rods 14 are inserted respectively through slots 21 in a circuit board 20, after which the terminal rods 14 are soldered to the circuit board 20, thereby mounting and positioning the switch 10 on the circuit board 20. The switch 10 is tilted or turned so as to shift from an OFF state to an ON state, and vice versa.

Although the aforementioned conventional switch 10 can achieve its intended purpose, since the lateral surfaces 143 of the terminal rods 14 are smooth, connections between the lateral surfaces 143 of the terminal rods 14 and the hole walls 132 of the through holes 131 are weak and unstable.

SUMMARY OF THE INVENTION

Therefore, the object of the present invention is to provide a rolling-ball switch that is capable of overcoming the aforementioned drawbacks of the prior art.

According to one aspect of this invention, a rolling-ball switch is adapted to be fixed on a circuit board. The rolling-ball switch comprises a housing, at least two terminal rods, and a conductive ball. The housing defines a chamber, and has a bottom wall provided with at least two through holes. Each of the through holes is defined by a multi-sided hole wall. Each of the terminal rods has an inner end extending into the chamber through a respective through hole, an outer end that is opposite to the inner end, that extends outwardly of the bottom wall, and that is adapted to be inserted into the circuit board, a multi-sided lateral surface extending between the inner and outer ends, and at least one engaging member provided on the multi-sided lateral surface and engaging the hole wall of the respective through hole. The conductive ball is disposed movably in the chamber to contact separably the inner ends of the terminal rods.

According to another aspect of this invention, a rolling-ball switch comprises a circuit board, a housing, four terminal rods, and a conductive ball. The circuit board has four slots. The housing defines a chamber, and has a top face, a bottom wall having a bottom face, and four side surfaces interconnecting the top and bottom faces. The bottom wall has four spaced-apart through holes penetrating the bottom face and arranged in a rectangular array. Each of the through holes is defined by a four-sided hole wall. The terminal rods are inserted respectively through the through holes. Each of the terminal rods has an inner end extending into the chamber, an outer end that is opposite to the inner end, that extends outwardly of the bottom wall, and that is inserted into a respective one of the slots in the circuit board, a four-sided lateral surface extending between the inner and outer ends, at least one first engaging member provided on the multi-sided lateral surface and engaging the hole wall of the respective through hole, and at least one second engaging member provided on the multi-sided lateral surface proximate to the outer end and engaging the respective slot in the circuit board. The conductive ball is disposed movably in the chamber to contact separably the inner ends of the terminal rods.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
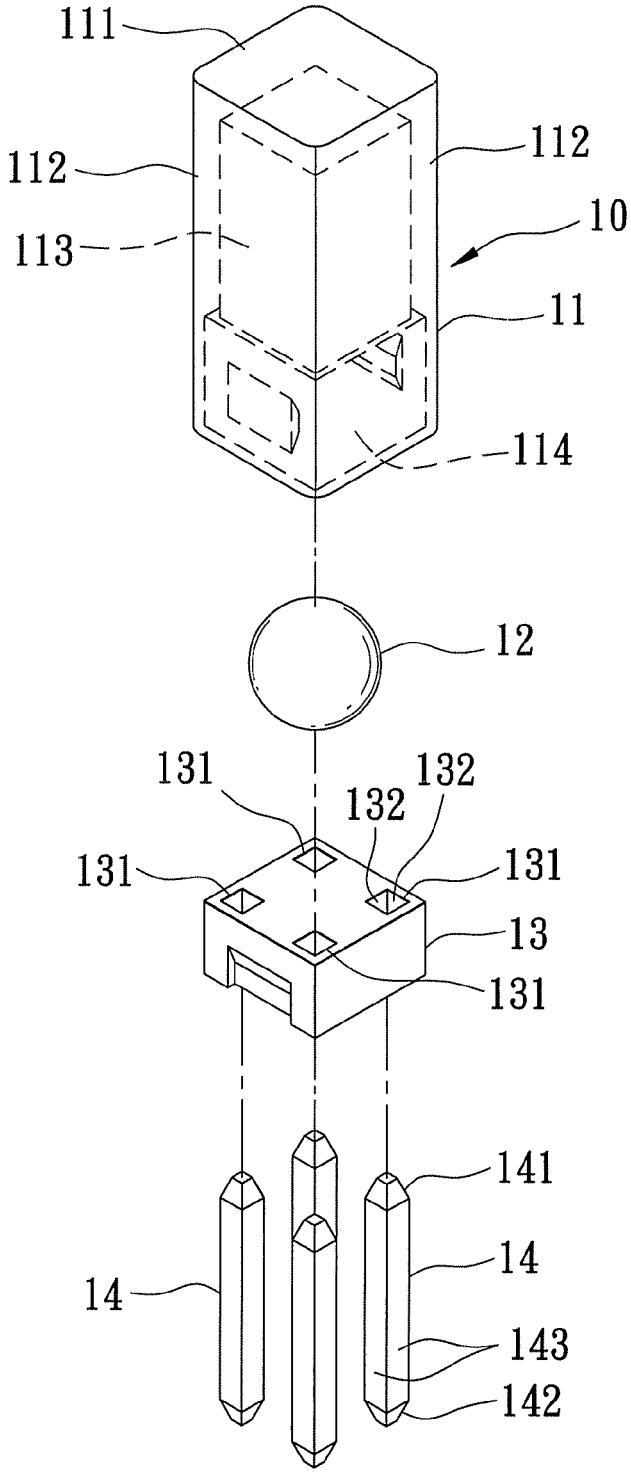
FIG. 1 PRIOR ART
FIG. 1 is an exploded perspective view of a conventional switch disclosed in Taiwanese Patent No. 155965.
Figure 2:
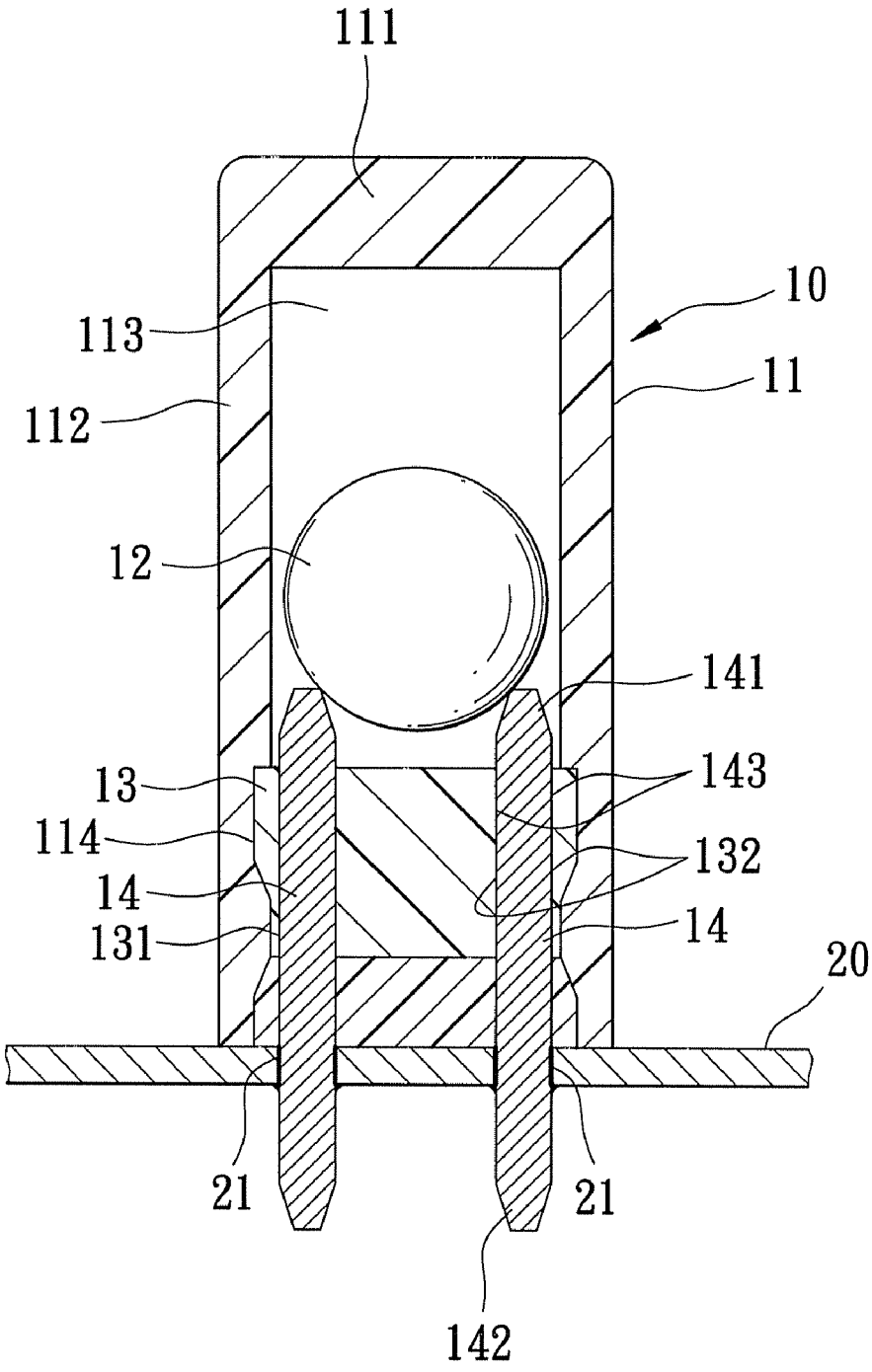
FIG. 2 PRIOR ART
FIG. 2 is an assembled sectional view of the conventional switch of FIG. 1.

Before the present invention is described in greater detail, it should be noted that like elements are denoted by the same reference numerals throughout the disclosure.

Referring to FIGS. 3 to 6, the first preferred embodiment of a rolling-ball switch 300 according to the present invention is shown to comprise a housing, a conductive ball 40, and four terminal rods 60.

The housing defines a chamber 33 having a bottom opening 34, and has a top face 301, a bottom face 302, and four side surfaces 303 interconnecting the top and bottom faces 301, 302. The housing includes a bottom seat 50 and a cover body 30. The bottom seat 50 is made of plastic, and has a bottom wall 52 having the bottom face 302 and formed with four spaced-apart through holes 51 that penetrate the bottom face 302 and that are arranged in a rectangular array. Each of the through holes 51 is defined by a four-sided hole wall 511.

The cover body 30 is made of plastic, and has a top wall 31 having the top face 301, and four interconnected side walls 32 extending downwardly from a peripheral end of the top wall 31 and beyond the bottom seat 50. The bottom seat 50 and the cover body 30 cooperatively define the chamber 33.

Each of the terminal rods 60 has an inner end 61 extending into the chamber 33 through a respective one of the through holes 51, and an outer end 62 that is opposite to the inner end 61, that extends outwardly of the bottom wall 52, and that is adapted to be inserted into a circuit board 100.

Figure 5:
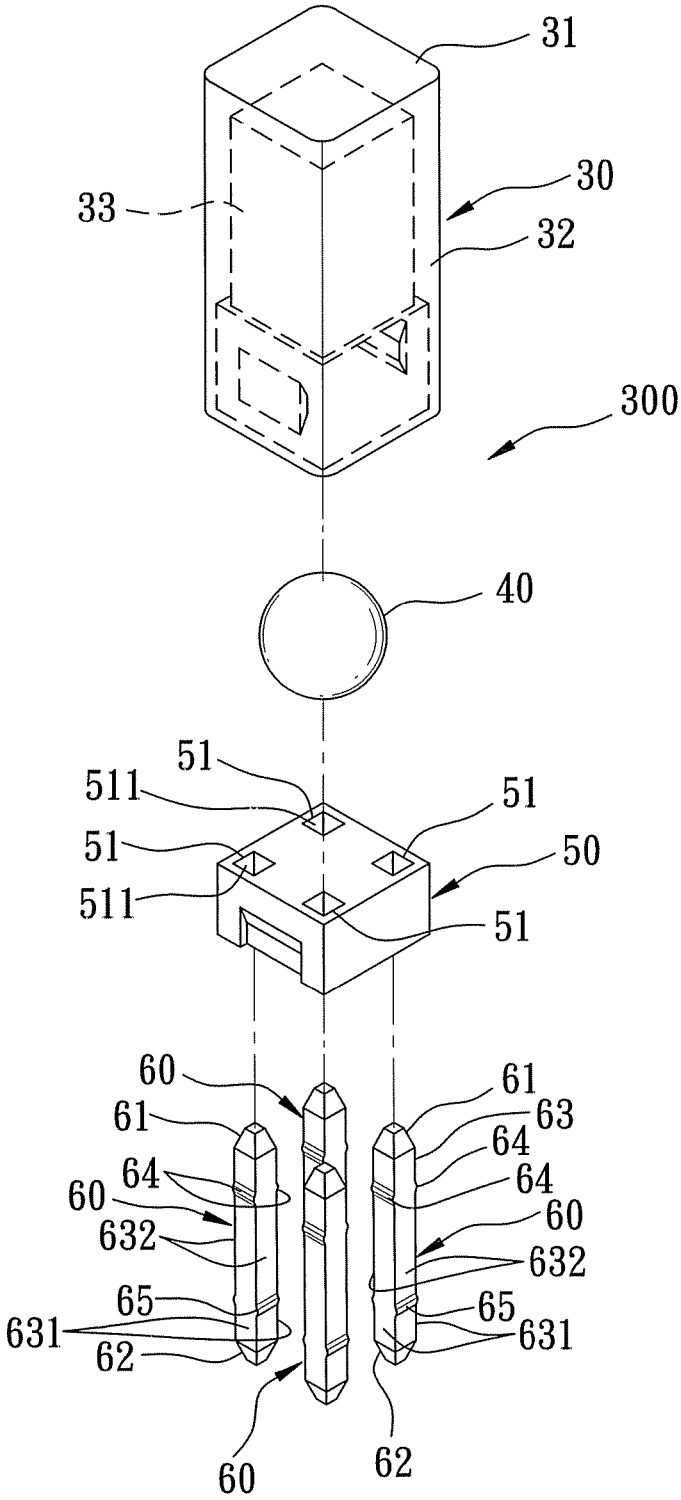
FIG. 5 is a view similar to FIG. 3, but with engaging members of terminal rods being configured as protrusions.
Figure 6:
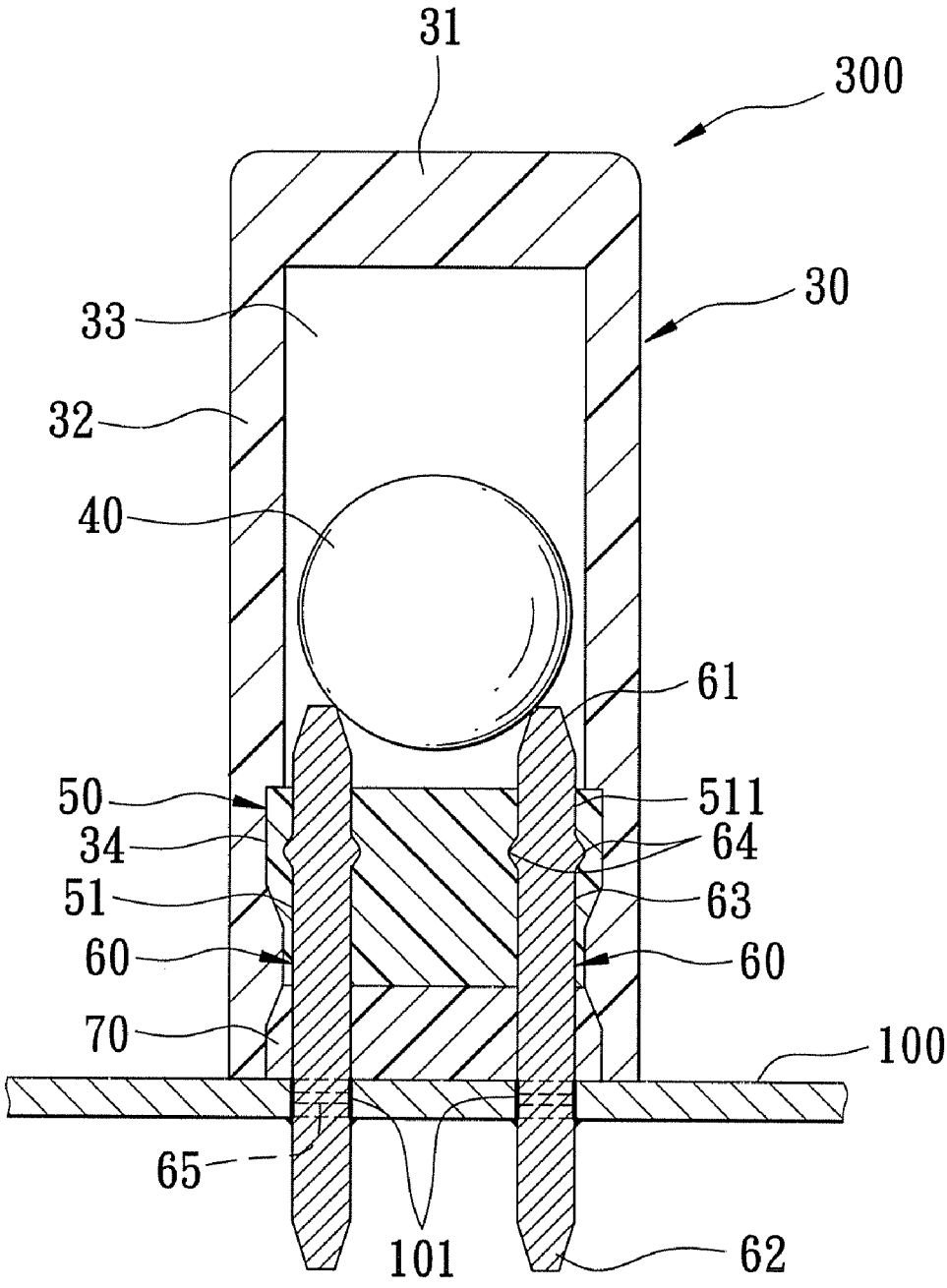
FIG. 6 is a view similar to FIG. 4, but with the engaging members of the terminal rods being configured as protrusions.
Figure 7:
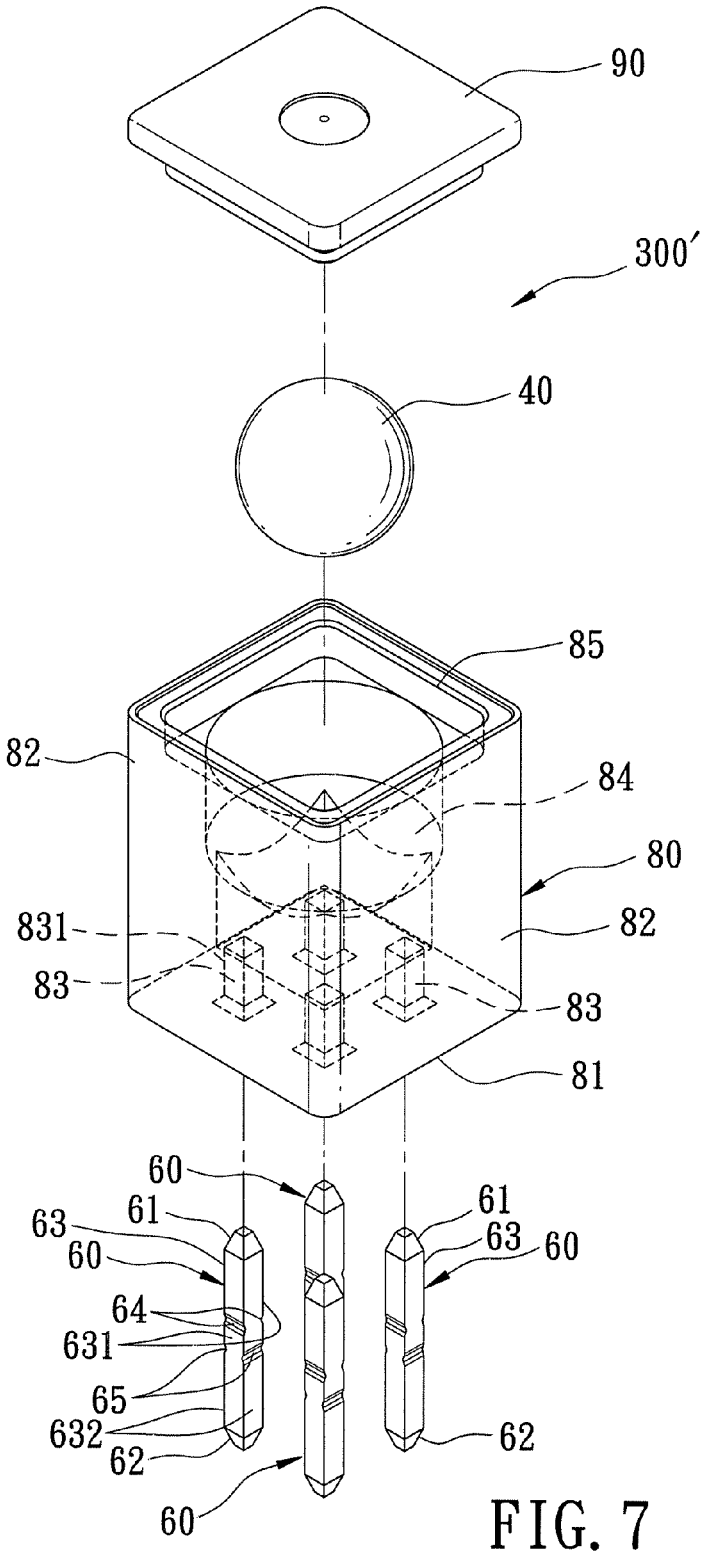
FIG. 7 is an exploded perspective view of the second preferred embodiment of a rolling-ball switch according to the present invention.
Figure 8:
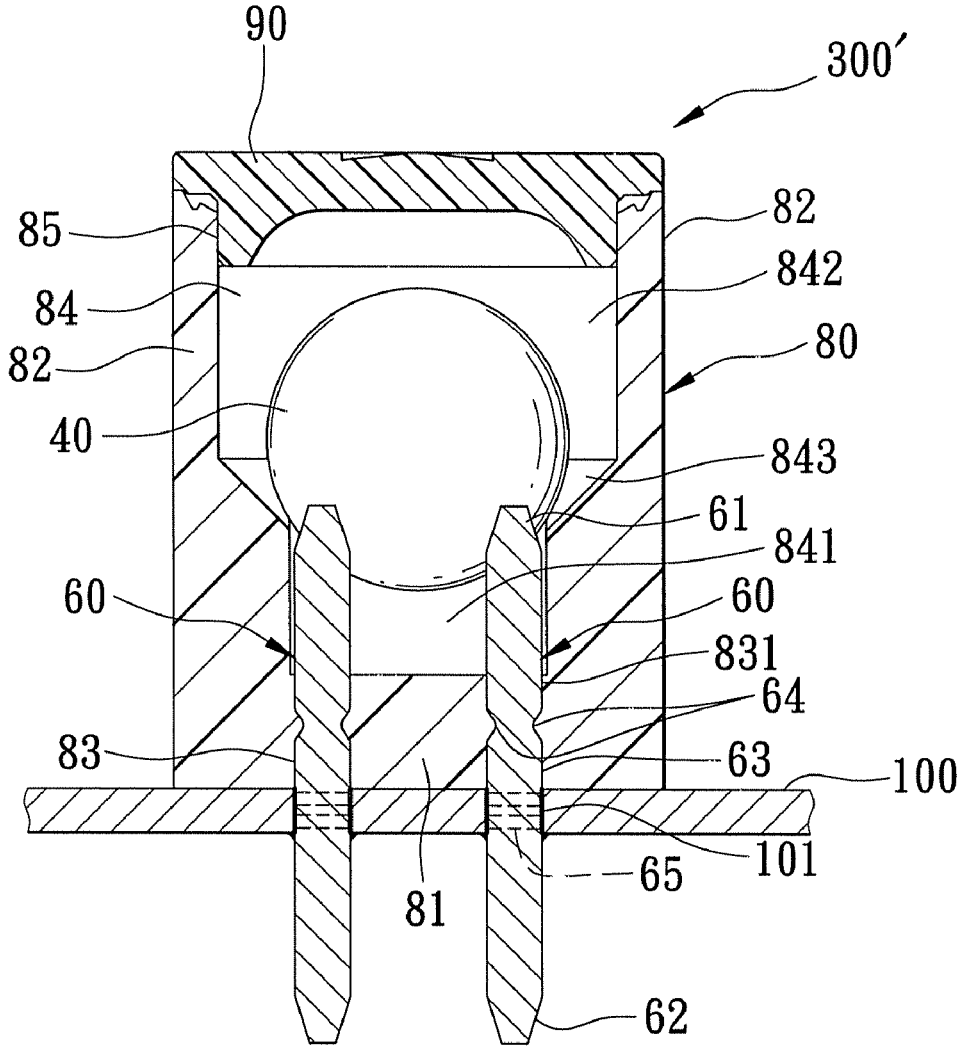
FIG. 8 is an assembled sectional view of the second preferred embodiment.

In this embodiment, each terminal rod 60 has a four-sided lateral surface 63 that extends between the inner and outer ends 61, 62 and that confronts the four-sided hole wall 511 of the respective through hole 51. The four-sided lateral surface 63 includes two opposite first sides 631 and two opposite second sides 632. Each of the first sides 631 is provided with a first engaging member 64 that engages the hole wall 511 of the respective through hole 51. Each of the second sides 632 is provided with a second engaging member 65 that is proximate to the outer end 62, that is spaced apart longitudinally from the first engaging members 64, and that engages a slot 101 in the circuit board 100. Each of the first and second engaging members 64, 65 is configured as an indentation. Alternatively, each of the first and second engaging members 64, 65 may be configured as a protrusion, as best shown in FIGS. 5 and 6.

The conductive ball 40 is disposed in the chamber 33, and is movable, in a conventional manner, toward the inner ends 61 of the terminal rods 60 so as to place the switch 300 in an "ON" state, or away from the inner ends 61 of the terminal rods 60 so as to place the switch 300 in an "OFF" state.

During assembly, the conductive ball 40 is first placed in the chamber 33, after which the bottom seat 50 is inserted into the chamber 33 so as to close the bottom opening 34 and thereby confine the conductive ball 40 within the chamber 33. The terminal rods 60 are then inserted respectively and interferentially into the through holes 51 by a jig (not shown) so that the four-sided lateral surface 63 of each terminal rod 60 abuts against the four-sided hole wall 511 of the respective through hole 51 with the first engaging members 64 facing the hole wall 511 of the respective through hole 51. Afterwards, a sealing member 70 is formed within a space defined by the bottom wall 52 (i.e., the bottom face 302 of the housing) and bottom ends of the side walls 32 of the cover body 30. A portion of each terminal rod 60 is embedded within the sealing member 70 at this time.

Figure 3:
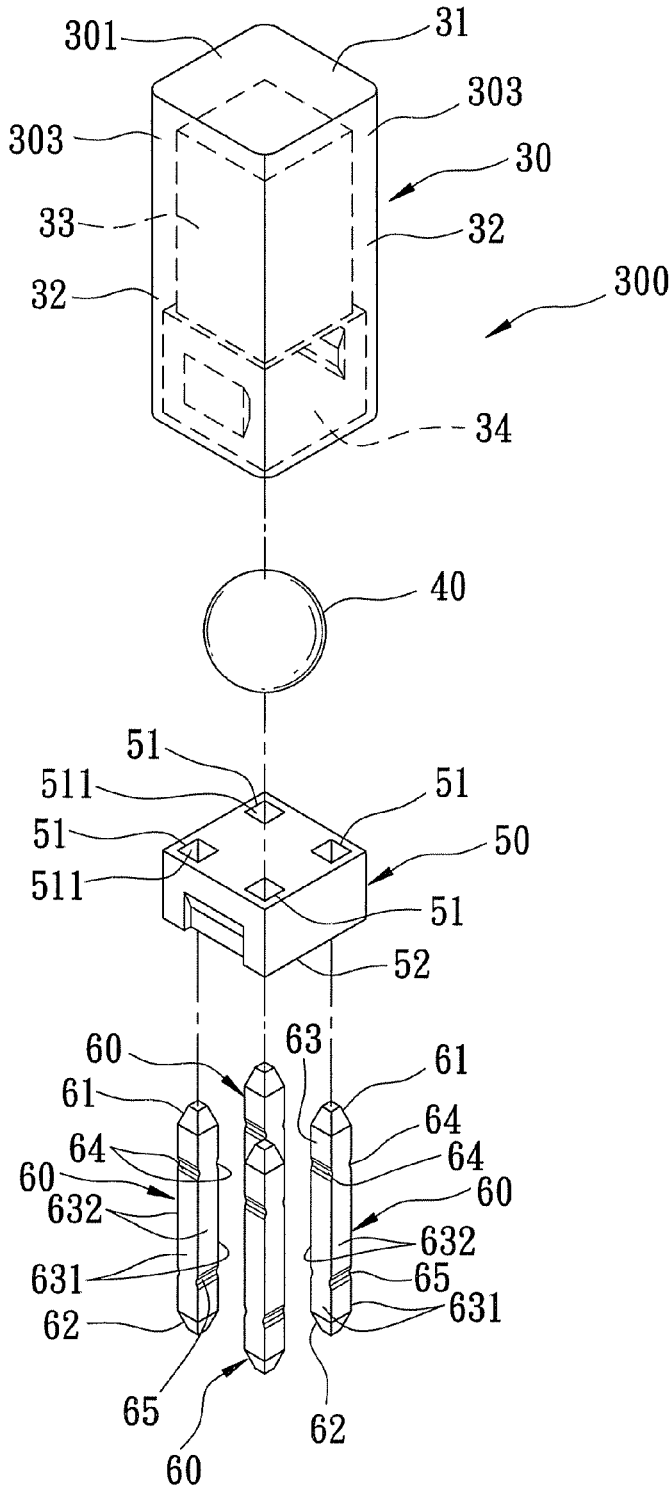
FIG. 3 is an exploded perspective view of the first preferred embodiment of a rolling-ball switch according to the present invention.
Figure 4:
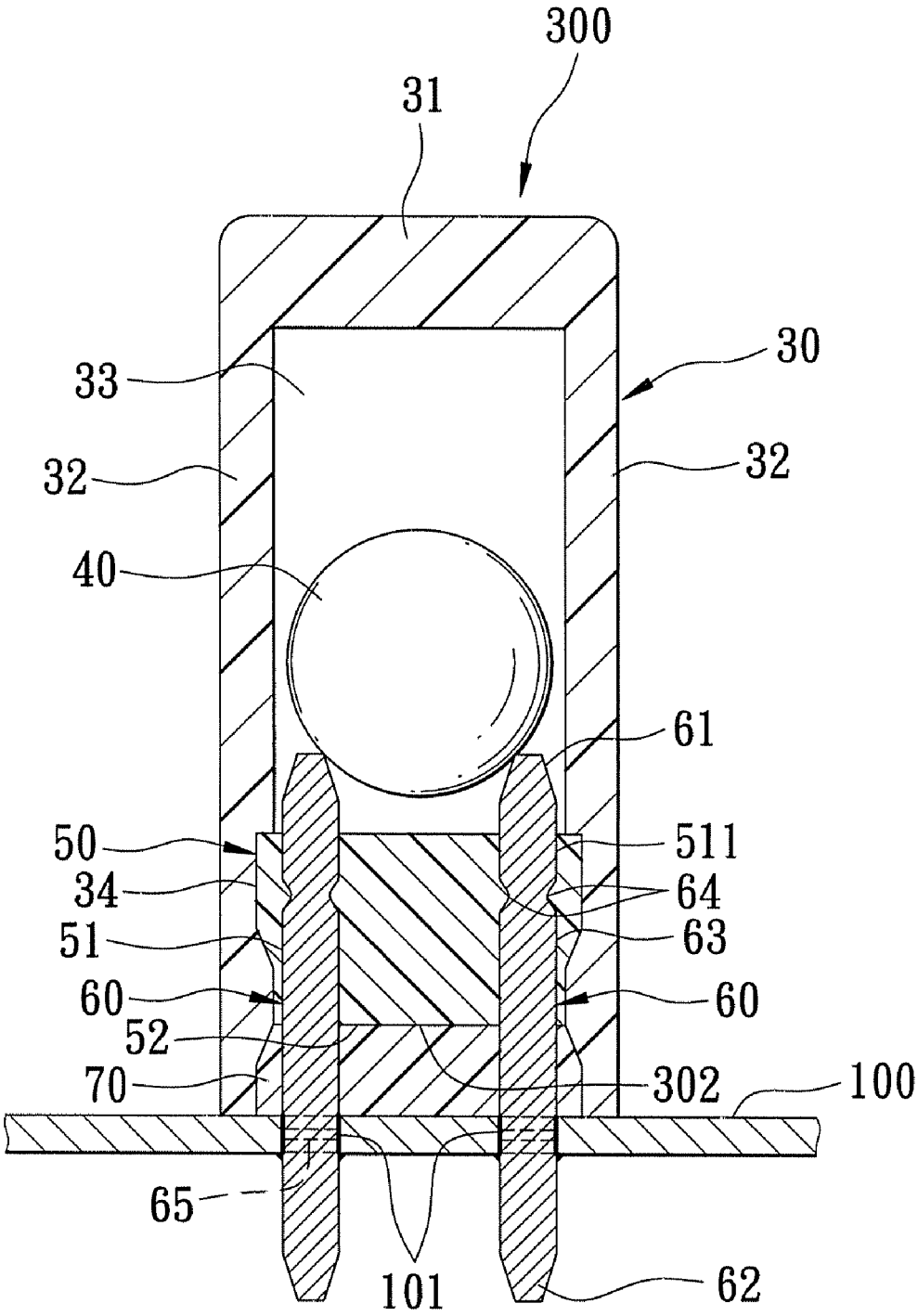
FIG. 4 is an assembled sectional view of the first preferred embodiment.

To mount the switch 300 fixedly on the circuit board 100, the outer ends 62 of the terminal rods 60 are inserted respectively through the slots 101 in the circuit board 100, after which the terminal rods 60 are soldered to the circuit board 100. The second engaging members 65 of the terminal rods 60 engage the slots 101 in the circuit board 100 at this time. Because of the high soldering temperature, the bottom wall 52 of the bottom seat 50 deforms so that the hole wall 511 of each through hole 51 also deforms to engage the first engaging members 64 of the corresponding terminal rod 60. That is, when the first engaging members 64 of each terminal rod 60 are formed as indentations, as shown in FIGS. 3 and 4, two opposite sides of the hole wall 511 of each through hole 51 that correspond to the first sides 631 of the lateral surface 63 of each terminal rod 60 deform to form protrusions that engage the indentations of the first engaging members 64. On the other hand, when the first engaging members 64 are formed as protrusions, as shown in FIGS. 5 and 6, the two opposite sides of the hole wall 511 of each through hole 51 that correspond to the first sides 631 of the lateral surface 63 of each terminal rod 60 deform to form indentations that engage the protrusions of the first engaging members 64. Hence, connections between the terminal rods 60 and the hole walls 511 of the through holes 51 can be enhanced. Further, through engagement of the second engaging members 65 of the terminal rods 60 with the slots 101 in the circuit board 100, the terminal rods 60 are positioned more stably within the circuit board 100.

Referring to FIGS. 7 to 10, the second preferred embodiment of a rolling-ball switch 300' according to the present invention is shown to comprise a housing 80, a conductive ball 40, and four terminal rods 60.

The housing 80 has a bottom wall 81, four interconnected side walls 82 extending upwardly from a peripheral end of the bottom wall 81, and a top cover 90. The top cover 90, the bottom wall 81, and the side walls 82 cooperatively define a chamber 84 having a top opening 85. The bottom wall 81 is formed with four spaced-apart through holes 83 arranged in a rectangular array. Each of the through holes 83 is defined by a four-sided hole wall 831. The top cover 90 is engaged to top ends of the side walls 82 so as to close the top opening 85 and thereby confine the conductive ball 40 within the chamber 84. The chamber 84 has a lower section 841 proximate to the bottom wall 81, an upper section 842 having a cross-section larger than that of the lower section 841, and a tapering section 843 extending downwardly from the upper section 842 to the lower section 841.

Figure 9:
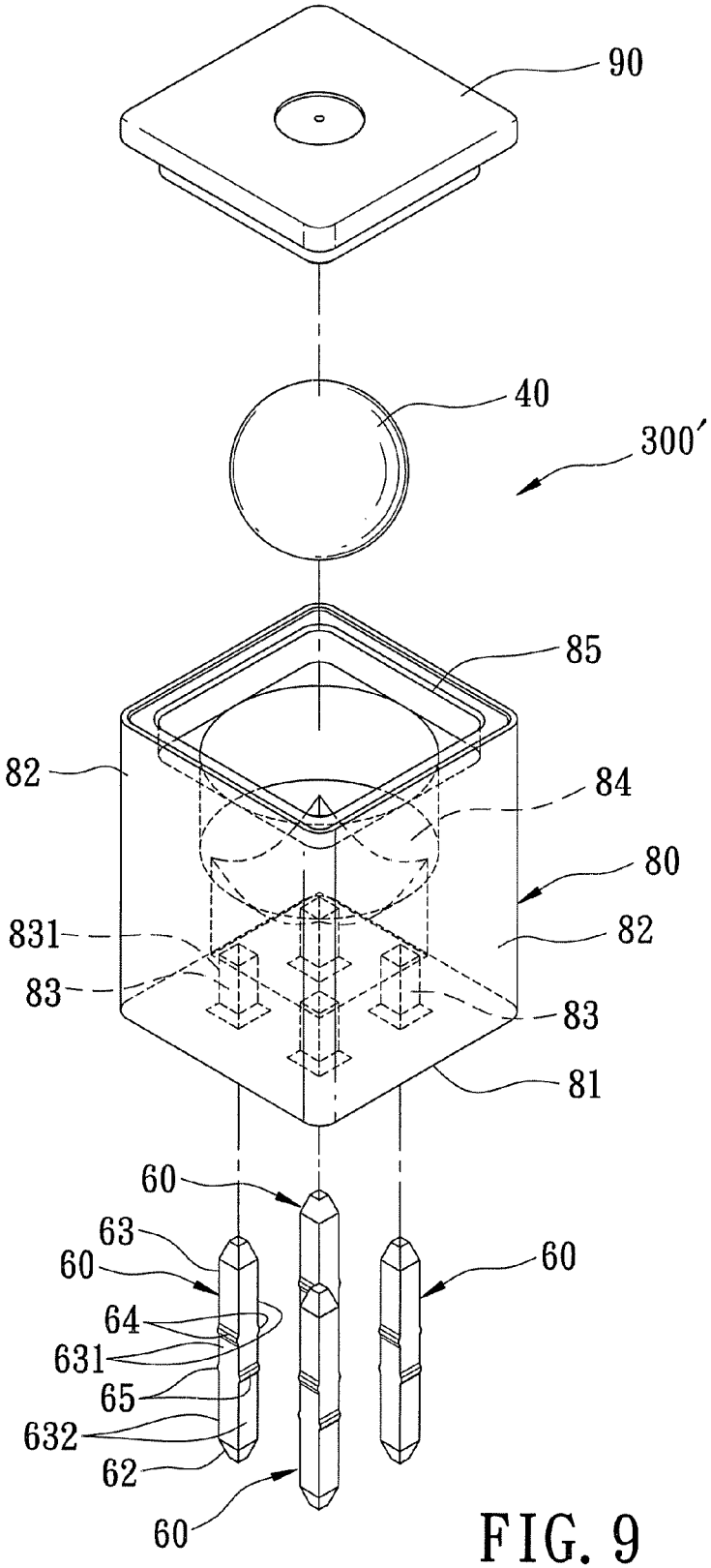
FIG. 9 is a view similar to FIG. 7, but with engaging members of terminal rods being configured as protrusions.
Figure 10:
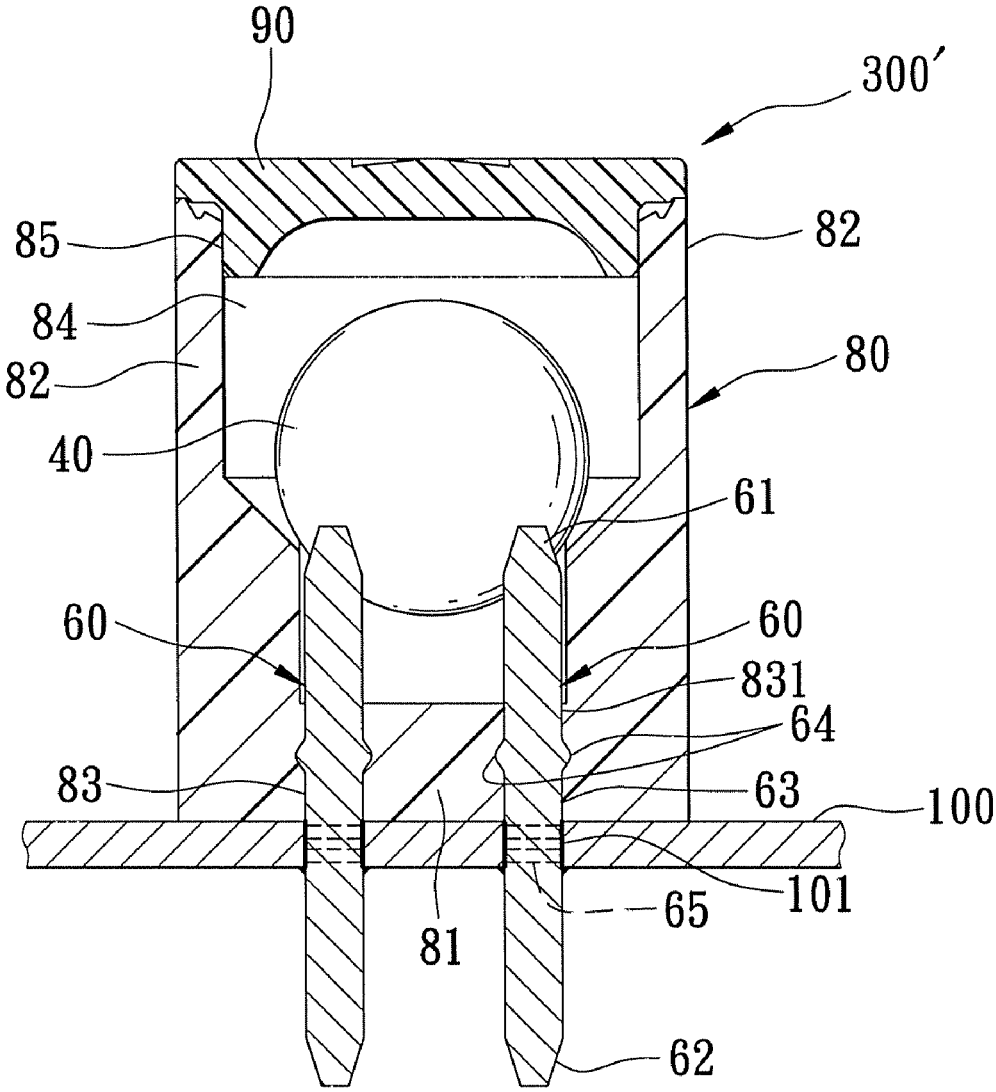
FIG. 10 is a view similar to FIG. 8, but with the engaging members of the terminal rods being configured as protrusions.

The terminal rods 60 are similar to those in the first preferred embodiment. Particularly, the terminal rods 60 are inserted respectively and interferentially into the through holes 83 by a jig (not shown). Each terminal rod 60 includes an inner end 61 extending into the tapering section 843 of the chamber 84 through the respective through hole 83, an outer end 62 extending outwardly of the bottom wall 81, a four-sided lateral surface 63 extending between the inner and outer ends 61, 62 and having two opposite first sides 631 and two opposite second sides 632, two first engaging members 64 provided respectively on the first sides 631, and two second engaging members 65 provided respectively on the second sides 632 and spaced apart longitudinally from the first engaging members 64. Each of the first and second engaging members 64, 65 is configured as an indentation. Alternatively, each of the first and second engaging members 64, 65 may be configured as a protrusion, as best shown in FIGS. 9 and 10.

Like the first preferred embodiment, the conductive ball 40 is movable toward or away from the inner ends 61 of the terminal rods 60 so as to place the switch 300 in an "ON" or "OFF" state.

During assembly, when the terminal rods 60 are soldered to the circuit board 100, the bottom wall 81 deforms as a result of the high soldering temperature so that the first engaging members 64 of each terminal rod 60 engage tightly the hole wall 831 of the respective through hole 83, thereby strengthening connections between the terminal rods 60 and the hole walls 831 of the through holes 83. Further, through engagement of the second engaging members 65 of the terminal rods 60 with the slots 101 in the circuit board 100, the terminal rods 60 are positioned more stably within the circuit board 100.

Therefore, from the aforementioned description, it is apparent that the object of the present invention is met.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A rolling-ball switch adapted to be fixed on a circuit board, said rolling-ball switch comprising:

a housing defining a chamber and having a deformable bottom wall provided with at least two through holes, each of said through holes being defined by a multi-sided hole wall;

at least two terminal rods, each of which has an inner end extending into said chamber through a respective one of said through holes, an outer end that is opposite to said inner end, that extends outwardly of said deformable bottom wall, and that is adapted to be inserted into the circuit board, a multi-sided lateral surface extending between said inner and outer ends, and at least one first engaging member provided on said multi-sided lateral surface and engaging said hole wall of the respective one of said through holes, wherein said at least two terminal rods are engaged to said deformable bottom wall by at least a deformed portion of said deformable bottom wall; and a conductive ball disposed movably in said chamber to contact separably said inner ends of said terminal rods.

2. The rolling-ball switch of claim 1, wherein each of said terminal rods further has at least one second engaging member that is provided on said multi-sided lateral surface proximate to said outer end and that is spaced apart longitudinally from said first engaging member, said second engaging member being adapted to engage the circuit board.

3. The rolling-ball switch of claim 2, wherein each of said first and second engaging members is configured as an indentation.

4. The rolling-ball switch of claim 2, wherein each of said first and second engaging members is configured as a protrusion.

5. The rolling-ball switch of claim 1, wherein said housing includes a bottom seat having said deformable bottom wall, and a cover body having a top wall, and four interconnected sidewalls extending downwardly from a peripheral end of said top wall and surrounding said bottom seat, said bottom seat and said cover body cooperatively defining said chamber.

6. The rolling-ball switch of claim 1, wherein said housing further has four interconnected side walls extending upwardly from a peripheral end of said deformable bottom wall, and a top cover disposed on top ends of said side walls of said housing, said top cover, said deformable bottom wall, and said sidewalls of said housing cooperatively defining said chamber.

7. The rolling-ball switch of claim 1, wherein said housing further has four interconnected side walls extending upwardly from a peripheral end of said deformable bottom wall, and a top cover disposed on top ends of said side walls of said housing and having said top face, said side walls having said side surfaces, said top cover, said deformable bottom wall, and said side walls cooperatively defining said chamber.

8. The rolling-ball switch of claim 7, wherein said chamber has a lower section proximate to said bottom face, an upper section having a cross-section larger than that of said lower section, and a tapering section extending downward from said upper section to said lower section, said inner ends of said terminal rods extending into said tapering section, said conductive ball being movable toward or away from said inner ends.

9. A rolling-ball switch comprising:

a circuit board having four slots;

a housing defining a chamber and having a top face, a deformable bottom wall having a bottom face, and four side surfaces interconnecting said top and bottom faces, said deformable bottom wall having four spaced-apart through holes penetrating said bottom face and arranged in a rectangular array, each of said through holes being defined by a four-sided hole wall;

four terminal rods inserted respectively through said through holes, each of said terminal rods having an inner end extending into said chamber, an outer end that is opposite to said inner end, that extends outwardly of said deformable bottom wall, and that is inserted into a respective one of said slots in said circuit board, a four-sided lateral surface extending between said inner and outer ends, at least one first engaging member provided on said multi-sided lateral surface and engaging said hole wall of the respective one of said through holes, wherein said four terminal rods are engaged to said deformable bottom wall by at least a deformed portion of said deformable bottom wall, and at least one second engaging member provided on said multi-sided lateral surface proximate to said outer end and engaging the respective one of said slots in said circuit board; and a conductive ball disposed movably in said chamber to contact separably said inner ends of said terminal rods.

10. The rolling-ball switch of claim 9, wherein each of said first and second engaging members is configured as an indentation.

11. The rolling-ball switch of claim 9, wherein each of said first and second engaging members is configured as a protrusion.

* * * * *